United States Patent [19]

Van Scoyk

[11] Patent Number: 4,942,721

[45] Date of Patent: Jul. 24, 1990

[54] YOUTH STIRRUP ATTACHMENT

[76] Inventor: Pershing R. Van Scoyk, 7193 W. 32nd Ave., Wheat Ridge, Colo. 80033

[21] Appl. No.: 318,651

[22] Filed: Mar. 3, 1989

[51] Int. Cl.[5] ..... B68C 1/16

[52] U.S. Cl. ..... 54/46

[58] Field of Search ..... 54/44, 46

[56] References Cited

U.S. PATENT DOCUMENTS

| | | | |
|---|---|---|---|
| 532,081 | 1/1895 | Metcalf | 54/44 |
| 862,572 | 8/1907 | Maussner | 54/46 X |
| 1,106,648 | 8/1914 | Graves | 54/46 |
| 3,112,592 | 11/1963 | Schindler | 54/44 |
| 3,234,711 | 2/1966 | Jamieson | 54/46 |
| 3,916,604 | 11/1975 | Phipps | 54/44 |
| 4,164,834 | 8/1979 | Christensen | 54/46 |
| 4,362,003 | 12/1982 | Robinson | 54/44 |
| 4,608,812 | 9/1986 | Willson | 54/44 |

*Primary Examiner*—Robert P. Swiatek

*Attorney, Agent, or Firm*—Dorr, Carson, Sloan & Peterson

[57] ABSTRACT

The present invention is a simple, inexpensive youth stirrup attachment which attaches to a standard-sized saddle to enable small children and youths to enjoy horseback riding. The attachment of the present invention is a single strap having stirrups mounted on each end and adjustment buckles to alter the length of the attachment. The strap is slipped through the opening in the pommel of the saddle and looped over the saddle horn. The pressure from the rider's feet in the stirrups will cause the strap to frictionally engage the saddle horn. With the current invention there is no need for additional straps or buckles as in prior devices.

6 Claims, 1 Drawing Sheet

Fig. 1
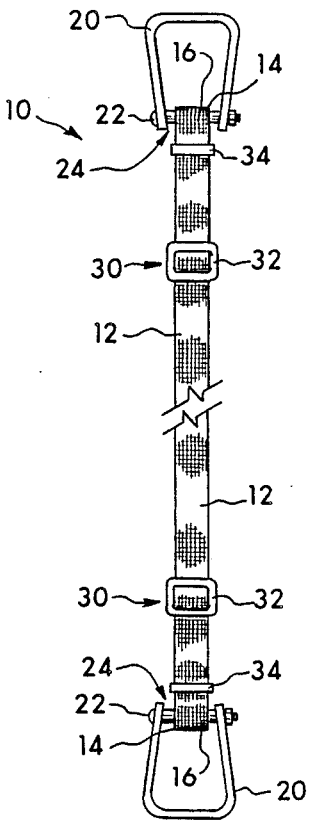
Fig. 2
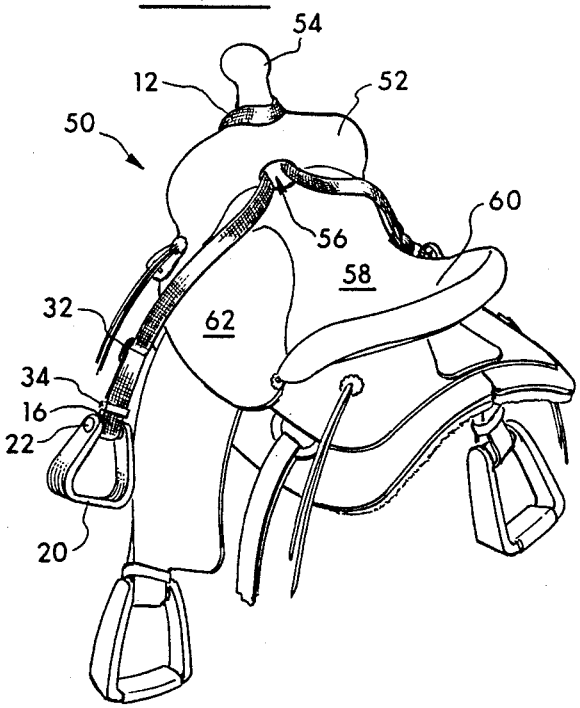
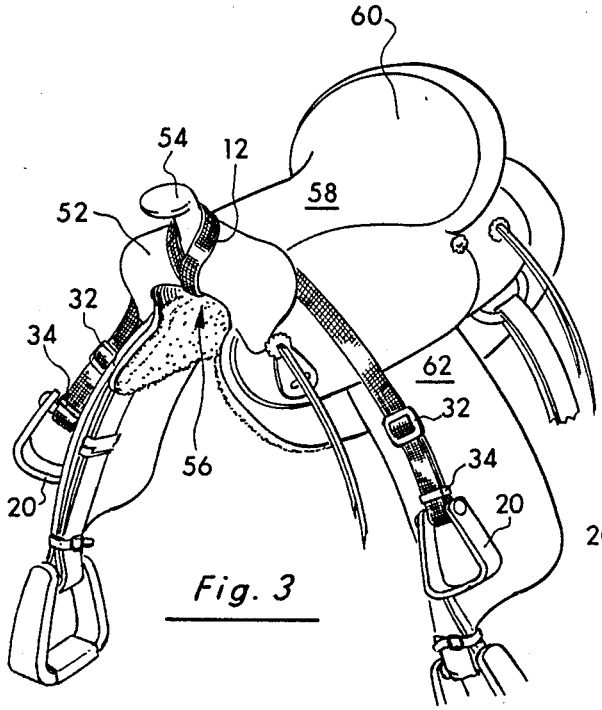
Fig. 3
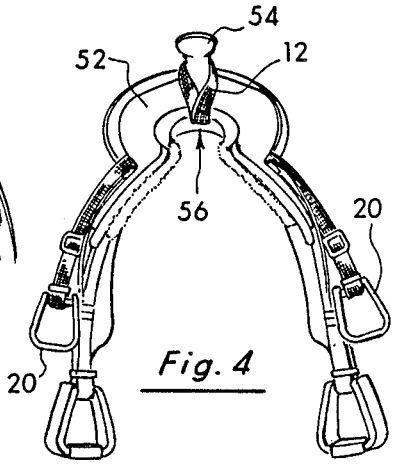
Fig. 4

YOUTH STIRRUP ATTACHMENT

BACKGROUND OF THE INVENTION

1. Field of the Invention

This invention relates to an attachment for western saddles, particularly to a stirrup attachment device designed for use by small children and youths.

2. Statement of the Problem

The enjoyment of horseback riding by small children and youths has always been hindered by the lack of low-cost alternatives to standard-sized saddles. A small child cannot properly fit on a standard-sized saddle and use the stirrups. The stirrups on such a saddle cannot be adequately adjusted for small children or youths.

There are available youth saddles, that is scaled-down versions of standard-sized saddles, but these are relatively expensive and quickly outgrown. The cost of constantly replacing these saddles as the child grows can be prohibitive. Further, there is very little available in saddles for the very young rider.

There presently exists several variations of accessories to standard-sized saddles that will enable a young rider to use the standard-size saddle. These include "piggyback" saddles which are merely smaller saddles that mount onto the standard-sized saddle instead of the horse itself. One example is shown by U.S. Pat. No. 3,112,592 issued to Schindler, which discloses a scaled-down "piggyback" saddle sized for a youth. This "piggyback" saddle is mounted onto a standard-sized saddle by straps on the front and rear of the smaller saddle attaching to the pommel and cantle of the larger saddle. The stirrups of the smaller saddle lie over the fender of the larger saddle. This approach has many of the same problems of the youth saddles, that is being expensive, with many of the features of a standard-sized saddle and quickly outgrown.

Another example of "piggyback" saddles is shown by U.S. Pat. No. 3,916,604 issued to Phipps, which discloses an equestrian training saddle for teaching a small child horsemanship. This approach utilizes a small training saddle which mounts directly on top of the pommel of a standard-sized saddle. The mounting is, however, unstable and places the rider in an unnatural position. The use of this saddle requires a second rider to accompany the young rider and is not designed for use by a single young rider.

Another arrangement using a "piggyback" saddle is taught by U.S. Pat. No. 4,362,003 issued to Robinson. This arrangement uses a small saddle strapped behind the cantle of a standard-sized saddle. This arrangement places the young rider in an abnormal position on the horse and has the problems of the other "piggyback" saddles.

The use of the different types of "piggyback" type youth saddles have similar problems. All are relatively expensive in that the saddles are quickly outgrown and the saddles are inherently unstable since they do not mount directly onto the horse but onto a standard-sized saddle.

A different approach is taught by U.S. Pat. No. 4,164,834 issued to Christensen. This patent discloses an auxiliary stirrup attachment which mounts onto a standard-sized saddle. The attachment comprises a main strap having stirrups mounted on either end and a small, forward-extending strap attached to its center. The small strap attaches over and under the pommel of the standard-sized saddle so that the main strap extends over the saddle body with the stirrups over the fenders on either side of the standard-sized saddle. This approach uses a plurality of straps and buckles requiring multiple adjustments to secure this particular auxiliary youth stirrup attachment on the standard-sized saddle.

Another version of this approach is disclosed by U.S. Pat. No. 4,608,812 issued to Willson. This version uses additional straps and buckles to secure the auxiliary stirrups around the pommel and to encircle the cantle of the standard-sized saddle.

Both versions of the auxiliary youth stirrup use multiple straps and buckles which are cumbersome and require constant adjustment to mount onto a standard-sized saddle. These straps and buckles also increase the expense of the devices. There currently exists a need for a simple, low-cost alternative to these approaches to enable a young rider to easily and safely ride horseback.

3. Solution to the Problem

The current invention solves this problem and others by providing a simple, low-cost alternative to the youth saddles, the "piggyback" saddles and the multiple-strap auxiliary youth stirrup attachments.

The current invention provides a youth stirrup attachment which uses a single strap not requiring additional straps or buckles, thus reducing the expense of the device.

The current invention provides a youth stirrup attachment which is easily and quickly mountable onto a standard-sized saddle.

The current invention provides an attachment which is easily adjustable by a young rider.

The current invention can be used on a any sized saddle by a young rider either alone or accompanied by an another rider.

The current invention provides a youth stirrup attachment which can be used on any size of western-style saddle.

SUMMARY OF THE INVENTION

The current invention provides a simple, inexpensive youth stirrup attachment which attaches to a standard-sized saddle. The youth stirrup attachment includes a single, flexible strap with stirrups sized for young riders attached on either end. The strap is preferably formed from nylon, leather, or any other suitable material. The strap in one embodiment is 1½ inches wide and 4 feet long including the stirrups.

Adjustment means are provided on either end, to enable a variety of different sized riders to use the youth stirrups. These adjustment means may be a sliding buckle, clasps, buckles and notches, velcro, or any well-known means to adjust a strap for varying lengths.

In use, the youth stirrup attachment of the current invention are attached to a standard-sized, or any sized, saddle, either before mounting the saddle on the horse or while the saddle is already mounted on the horse. The strap is held so that it is evenly folded in half. The center portion of the strap is thrust through the opening in the pommel beneath the horn of the saddle from the cantle side of the saddle. The center portion of the strap is pulled through the opening and placed over the horn of the saddle. The ends of the strap are pulled toward the rear of saddle to secure the center portion of the strap against the saddle horn. The stirrups of the attachment are then placed so they lie over the fenders of the saddle. The strap ends can then be adjusted so that the feet of the young rider can comfortably fit into the stirrups.

To remove the youth stirrup attachment from the saddle, the strap is simply pushed through the opening beneath the saddle horn to remove the strain from the center of strap against the saddle horn. The strap can then be lifted over the saddle horn and pulled through the opening beneath the saddle horn.

The youth stirrup attachment of the current invention is a relatively inexpensive device which can quickly and easily be mounted and adjusted by a young rider onto any size or style of saddle having a saddle horn. There are no complicated adjustments to multiple straps or buckles necessary nor additional expenses created by the use of multiple straps or buckles or other saddle features of the prior art devices.

These and other features will be obvious from the written description in conjunction with the drawings.

The claimed invention is not meant to be limited by the description of the invention but encompasses all variations and modifications within the range of the inventive scope of the invention.

BRIEF DESCRIPTION OF THE DRAWINGS

FIG. 1 is a view of the youth stirrup of the current invention;

FIG. 2 is a rear perspective view of the youth stirrup mounted onto a standard-sized saddle;

FIG. 3 is a front perspective view of the youth stirrup mounted onto a standard-sized saddle;

FIG. 4 is a front view of the youth stirrup mounted onto a standard-sized saddle.

DETAILED DESCRIPTION OF THE INVENTION

The preferred embodiment of the invention is illustrated in FIGS. 1–4. The preferred embodiment of the youth stirrup attachment 10 of the current invention is shown mounted on a standard-sized western saddle 50 in FIGS. 2–4. The current invention is not meant to be limited by the preferred embodiment or by use to standard-sized western saddles but may be used on any size or style saddle having a pommel or saddle horn or any other saddle type on which the youth stirrup attachment 10 is capable of being mounted.

As shown in FIG. 1, the youth stirrup attachment 10 comprises a flexible strap 12. The strap 12 can be formed of nylon, leather, or any other suitable high strength, flexible material. The strap 12 in the preferred embodiment is approximately 1½ inches wide and approximately 3 feet long. The strap 12 is not meant to be physically limited to these dimensions but may be any width or length as necessary to accomplish the goals of the invention.

The youth stirrup attachment 10 has stirrups 20 attached to either end 14 of the strap 12, as illustrated in FIGS. 1–3. The stirrups 20 are conventional in design and are adapted to fit the size of the young riders. The stirrups 20 are formed with an open end 24 and with a bolt or pin 22 mounted across the open end 24. The strap 12 in the preferred embodiment is formed with a loop 16 as discussed further below, on each end 14 of the strap 12. The ends 14 of the strap are placed in the open end 24 of the stirrup so the bolt or pin 22 is mounted through the loop 16 on each end 14 of the strap 12. The bolt or pin 22 is secured across the open end 24 of the stirrup 20, thus fastening the stirrups 20 to the ends 14 of the strap 12.

The youth stirrup attachment 10 is formed with a means to adjust the length of the stirrup attachment to fit the individual rider. This enables the attachment 10 to be used by a wide variety of differing sized riders as well as to be usable as the young rider grows in stature. The preferred embodiment includes an adjustment device 30 as shown in FIG. 1. The adjustment device 30 of the preferred embodiment of the youth stirrup attachment 10 uses a sliding buckle 32 on each end 14 of the strap 12. The buckles 32, as seen in FIG. 1, are rectangular or oval in shape, with a bar across the center, longitudinally extending portion of the buckle. The ends of the strap 12 are attached to the center bar of the respective buckle 32. The strap 12 is slipped back through the buckles 32 to form the loops 16 on each end of the strap 12. The buckles 32 are thus mounted onto the strap 12 to slide up and down the length of the strap. As the buckles 32 are slid away from the stirrups 20, the length of the youth stirrup attachment 10 is shortened and as the buckles are slid toward the stirrups 20, the length of the youth stirrup attachment 10 is increased.

A retainer 34 is mounted on each end of the strap 12 as is shown in FIG. 1. The retainer 34 encircles both sides of the loops 16 formed by the strap 12. This prevents the loops 16 from becoming too large and open where they might snag on the saddle 50 or some other object. The retainers 34 are slidable on the strap 12 so that they may be adjusted as the buckles are adjusted, to control the size of the loops 16.

The invention is not meant to be limited solely to this embodiment but is meant to encompass other variations of and modifications. For instance, a clasp or other well-known adjustment devices may be used for adjustment purposes in lieu of the sliding buckles.

The youth stirrup attachment 10 is designed for use with a saddle such as the saddle 50 shown in FIGS. 2 through 4. However, the attachment can easily be used with other saddle types. The mounting of the youth stirrup attachment 10 is easily done by a young rider. The strap 12 is folded evenly in half so the stirrups 20 are at the same distance from the center portion of the strap. The center portion of the strap is then thrust through the opening 56 in the pommel 52 of the saddle 50 directly below the saddle horn 54 from the direction of the rear 60 of the saddle. The center portion of the strap is pulled through the opening 56 to the front of the saddle and looped over the saddle horn 54 as shown in FIG. 4. The strap 12 is then pulled backwards toward the rear 60 of the saddle until the looped center portion of the strap 12 is tightened against the saddle horn 54. The remaining portion of the strap 12 is placed on each side of the saddle over the fenders 62 of the saddle 50. The length of the stirrups 20 can then be adjusted by the adjustment devices 30 so the rider's feet comfortably fit in the stirrups.

The pressure from the rider's feet will place pressure on the strap 12 against the saddle horn 54. The friction between the strap 12 and the saddle horn 54 will prevent the strap from slipping. The youth stirrup attachment 10 can easily be attached on the saddle either before the saddle is mounted on the horse, or attached while the saddle is already mounted on the horse.

The youth stirrup attachment is easily removable from the saddle 50. The pressure is removed from the stirrups 20, and the strap 12 is slipped through the opening 56 from the direction of the rear 60 of the saddle. This removes the strain between the looped center portion of the strap against the saddle horn 54. The looped center portion of the strap is then lifted over the saddle horn 54 and pulled back through the opening 56. The youth stirrup attachment can easily and quickly be attached to and removed from saddles by riders of almost any age and skill.

The youth stirrup attachment of the current invention provides a low-cost alternative to the existing devices for young riders. This attachment does not require the expensive and quickly outgrown features of a youth or piggyback-style saddle nor does it use the cumbersome and complicated multiple straps and buckles of the prior stirrup attachments. The invention is designed to be easy to attach and remove so that a young rider may mount the attachment without assistance. The attachment is easily adjustable, so that a wide range of differing size of riders may use the device. The youth stirrup attachment of the current invention is capable of being used on a variety of different sized and styles of saddles. This invention solves the need for a simple, low-cost device to enable young riders to fully enjoy horseback riding.

It is to be expressly understood that the claimed invention is not meant to be limited to the above description of the preferred embodiment but encompasses the alterations and modifications within the scope of the inventive concept.

I claim:

1. A method of mounting a youth stirrup attachment on a saddle, said saddle having a saddle horn, a pommel, and an opening in said pommel below said saddle horn; said attachment having a single elongated strap with stirrups mounted on each end of said strap; said method comprising the steps of:

(a) folding said strap evenly in half so that said stirrups are substantially equal distance from the center portion of said strap;

(b) inserting said center portion of said strap through said opening in said pommel of said saddle from the rear of said saddle;

(c) pulling said center portion of said strap through said opening to the front of said saddle;

(d) looping said center portion of said strap over said saddle horn;

(e) pulling said ends of said strap towards said rear of said saddle to frictionally engage said center portion of said strap with said saddle horn; and (f) placing said stirrups over the fenders of said saddle.

2. The method of claim 1, wherein said attachment further includes means to adjust the length of said attachment; said method further comprising the steps:

(g) adjusting the length of said attachment to fit the size the rider.

3. A combination full-sized adult saddle having a saddle horn and a hole formed in the pommel of said saddle and a youth stirrup attachment for a person having a small build to ride horseback using said saddle, said attachment comprising:

an elongated strap;

a first stirrup mounted on one end of said strap;

a second stirrup mounted on the other end of said strap; said strap retaining said attachment on said saddle solely by frictional engagement of said strap with the rear of said saddle horn, whereby said strap is inserted through said hole and looped over said saddle horn so said strap frictionally engages said rear of said saddle horn as weight is applied to both of said stirrups.

4. The combination of claim 3 wherein said attachment further comprises means to adjust the length of said attachment.

5. The combination of claim 4 wherein said adjustment means comprise a buckle fixed to each end of said strap through which said strap is doubled back through said buckle to form a loop on each end of said strap, wherein each of said buckles slides on said strap to adjust said length of said attachment.

6. The combination of claim 3, wherein said strap is formed from a high-strength material.

* * * * *